US006722899B2

(12) United States Patent
Kato et al.

(10) Patent No.: US 6,722,899 B2
(45) Date of Patent: Apr. 20, 2004

(54) CONNECTIVE APPARATUS IN WHICH A NUMBER OF CONTACTS ARE GROUPED INTO A PLURALITY OF CONTACT GROUPS ACCORDING TO INTENDED USE

(75) Inventors: Nobukazu Kato, Fussa (JP); Tomohiko Tamada, Hamura (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/372,574

(22) Filed: Feb. 21, 2003

(65) Prior Publication Data

US 2003/0129865 A1 Jul. 10, 2003

Related U.S. Application Data

(62) Division of application No. 09/660,698, filed on Sep. 13, 2000, now abandoned.

(30) Foreign Application Priority Data

Apr. 28, 2000 (JP) ..... 2000-131129

(51) Int. Cl.[7] ..... H01R 4/66
(52) U.S. Cl. ..... 439/108; 439/719
(58) Field of Search ..... 439/101, 108, 439/79, 76.1, 638, 719, 397, 579, 497, 942

(56) References Cited

U.S. PATENT DOCUMENTS

| | | | | | |
|---|---|---|---|---|---|
| 5,244,397 | A | * | 9/1993 | Anhalt | 439/101 |
| RE35,896 | E | * | 9/1998 | Brunker et al. | 439/108 |
| 6,364,701 | B1 | * | 4/2002 | O'Sullivan et al. | 439/579 |
| 6,524,119 | B2 | * | 2/2003 | Kato et al. | 439/79 |

FOREIGN PATENT DOCUMENTS

| | | |
|---|---|---|
| JP | 7-122336 | 5/1995 |
| JP | 8-503332 | 4/1996 |
| JP | 9-245909 | 9/1997 |

* cited by examiner

*Primary Examiner*—Renee Luebke
*Assistant Examiner*—Felix O. Figueroa
(74) *Attorney, Agent, or Firm*—Michael Best & Friedrich LLP

(57) ABSTRACT

In a connector (23) in which a number of contacts are placed inside a coupling portion (26), the contacts are grouped into a plurality of contact groups (31, 32, 33, 34, and 35) that correspond to intended uses, respectively. The contacts are collectively arranged in each of the contact groups. The coupling portion is held by an insulator (28) and is for coupling to a mating connector. The contacts are held by the insulator and connected to the mating connector when the coupling portion is coupled to the mating connector.

3 Claims, 18 Drawing Sheets

FIG. 7B
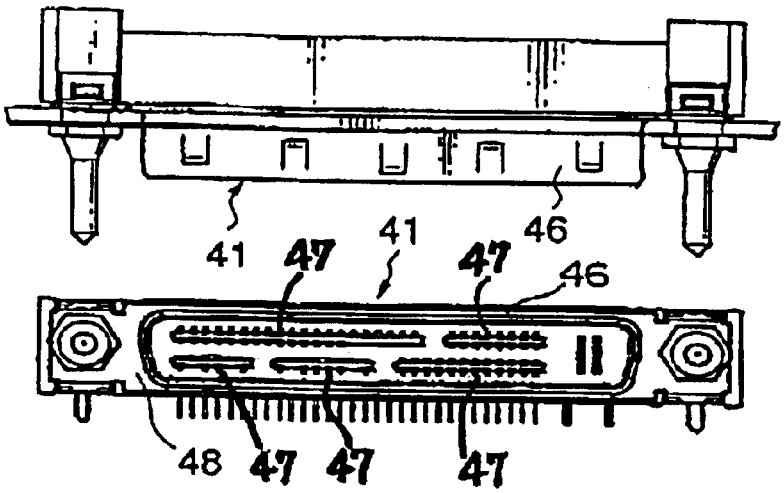
FIG. 7A
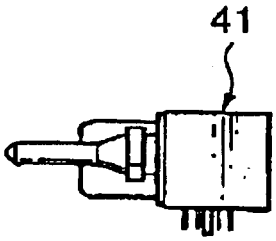
FIG. 7C
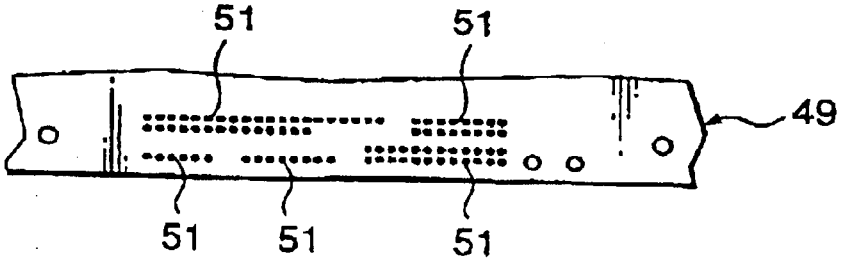
FIG. 8

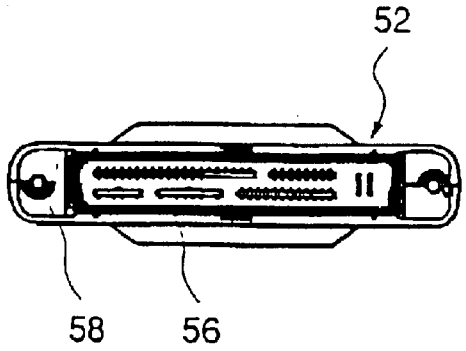
FIG. 9A
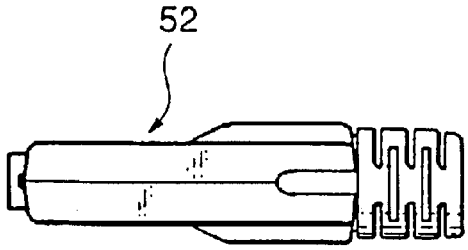
FIG. 9B
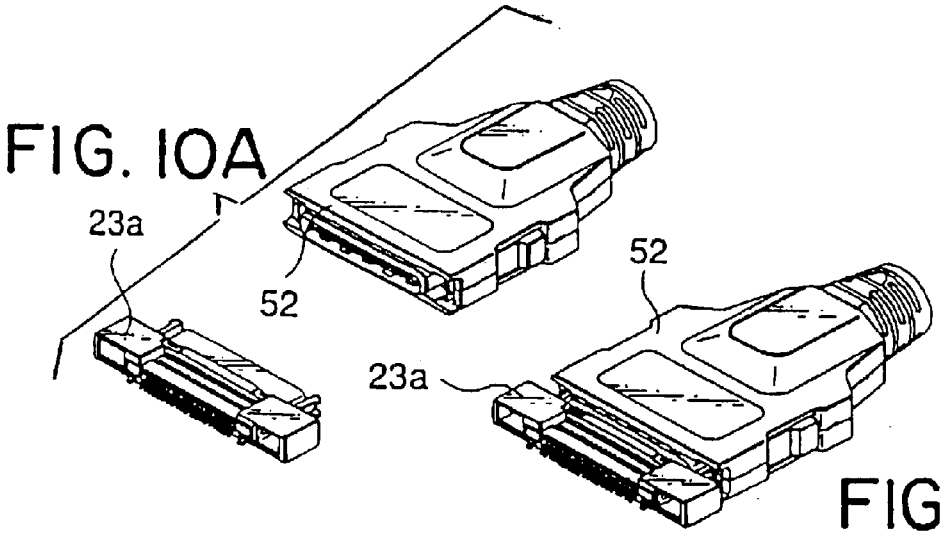
FIG. 10A
FIG. 10B

FIG. 17B
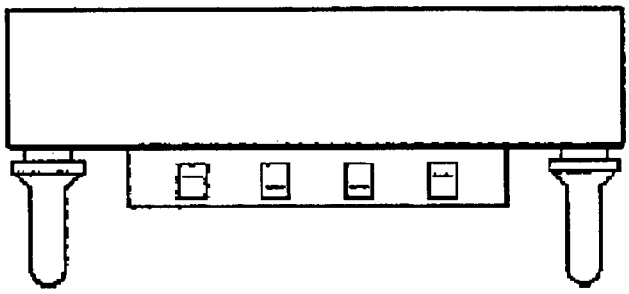
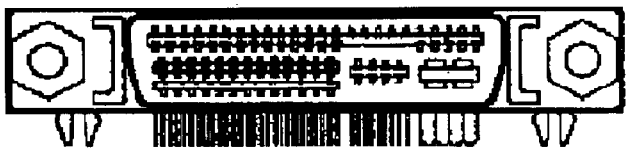
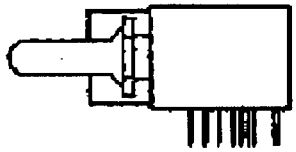
FIG. 17A
FIG. 17C

FIG. 18B
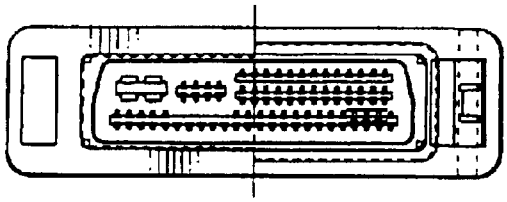
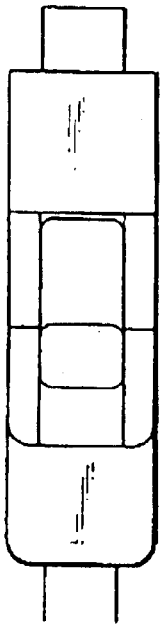
FIG. 18C
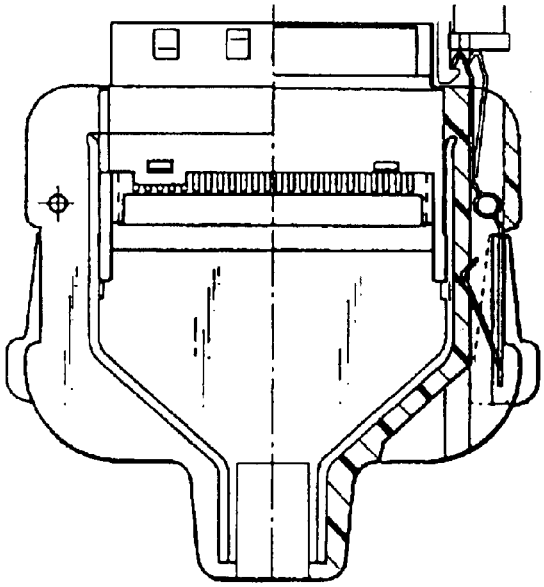
FIG. 18A
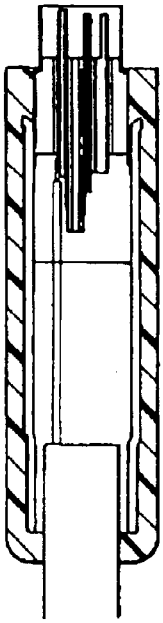
FIG. 18E
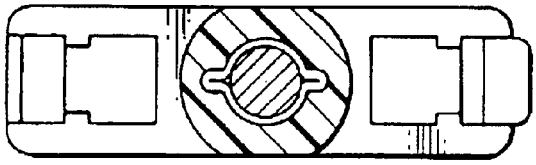
FIG. 18D FIG. 19C
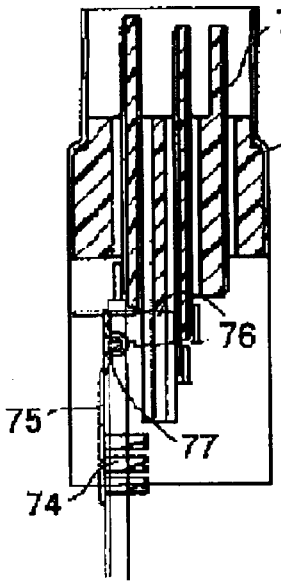
FIG. 19A
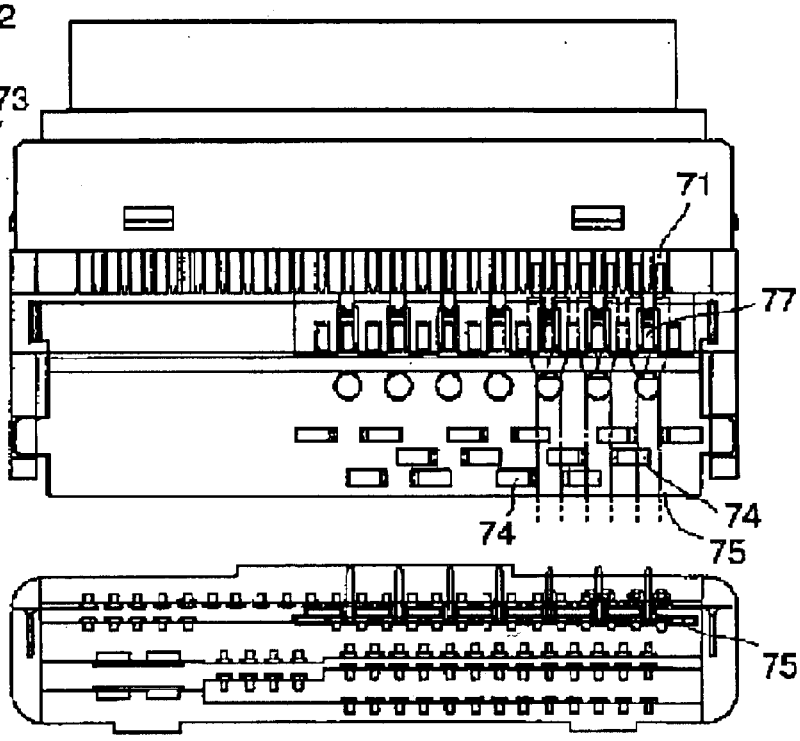
FIG. 19B FIG. 21C
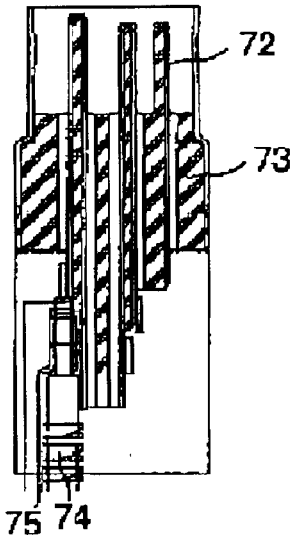
FIG. 21A
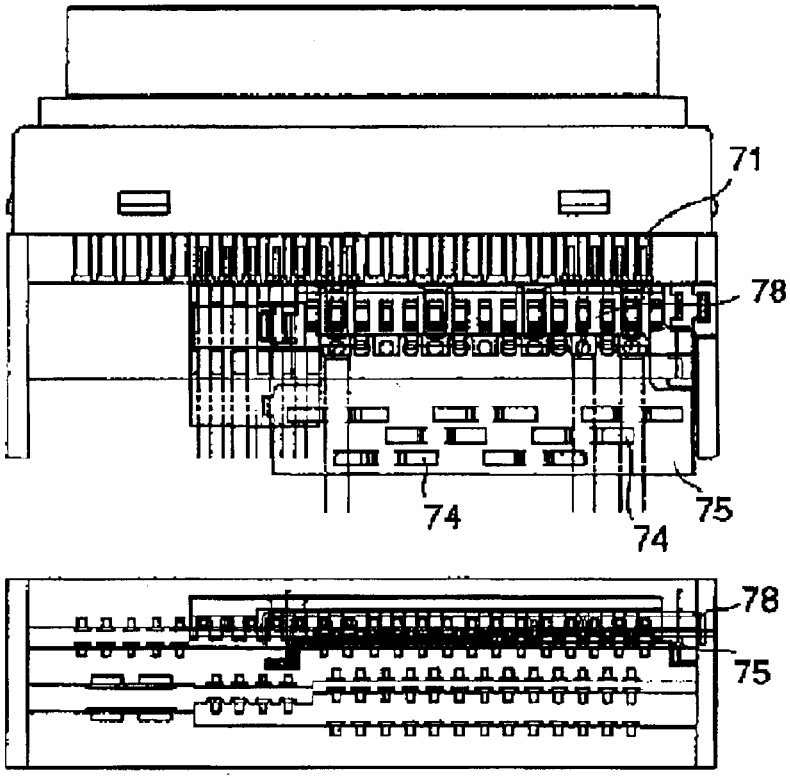
FIG. 21B FIG. 22A
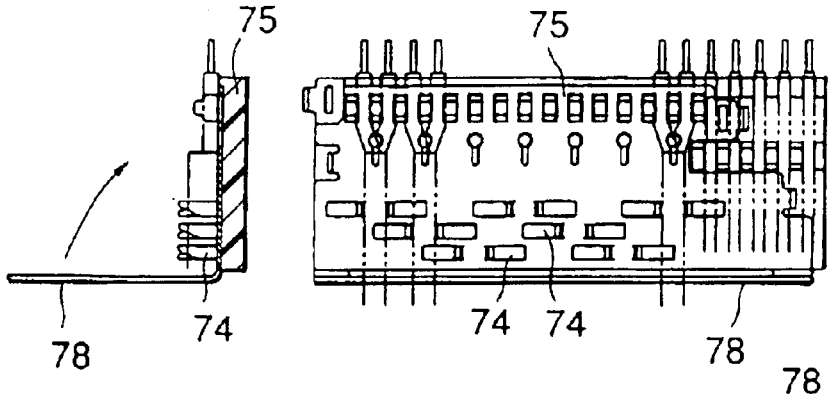
FIG. 22C
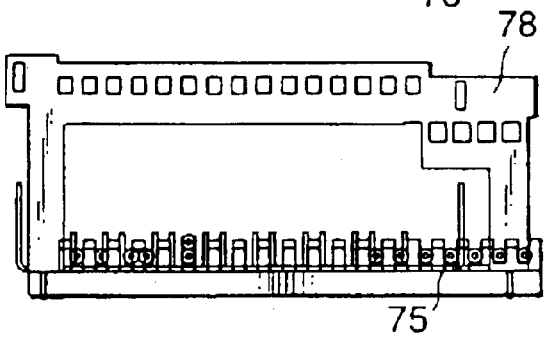
FIG. 22B
FIG. 23A
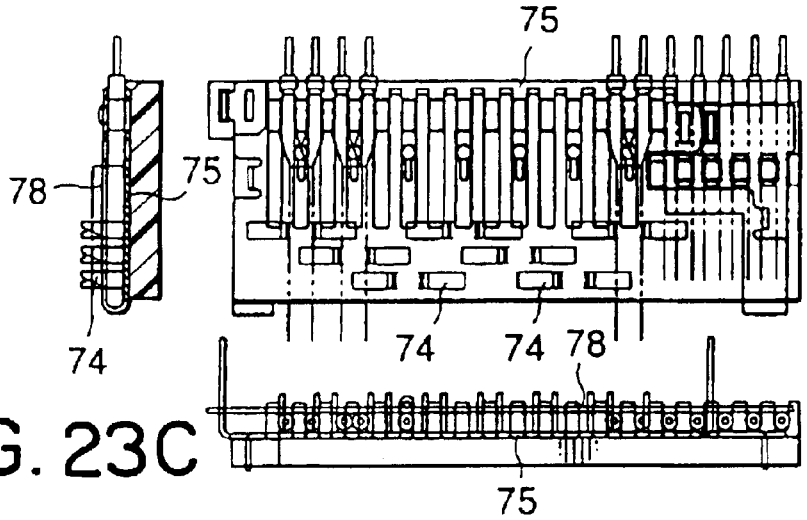
FIG. 23C
FIG. 23B

CONNECTIVE APPARATUS IN WHICH A NUMBER OF CONTACTS ARE GROUPED INTO A PLURALITY OF CONTACT GROUPS ACCORDING TO INTENDED USE

CROSS REFERENCE TO RELATED APPLICATIONS

This application is a divisional of U.S. application Ser. No. 09/660,698 filed Sep. 13, 2000, now abandoned.

BACKGROUND OF THE INVENTION

This invention relates to a connector comprising a number of contacts to be connected to a number of circuits.

An information processing apparatus such as a personal computer 10 illustrated in FIG. 1 transmits and receives various kinds of signals. For input and output of these signals, the personal computer 10 is provided with a plurality of connectors 11, 12, and 13 different in shape and typically formed on its rear side.

The connector 11 is intended to be connected to a connector 15 of a docking station 14 or a connector 17 of a port replicator 16. Each of the connectors 12 and 13 is adapted to be connected to a connector 19 of a peripheral device 18 such as a CD (Compact Disc) drive and a DVD (Digital Video Disc) drive. The docking station 14 and the port replicator 16 have connectors 21 and 22, respectively, which can be connected to the connector 19 of the peripheral device 18.

Thus, the personal computer 10 is adapted to be connected to various types of peripheral devices. Therefore, the connectors 11, 12, and 13 are supplied with various kinds of signals.

In the personal computer 10, the connectors 11, 12, and 13 are not classified in accordance with the kinds of signals supplied thereto. Therefore, each of the connectors 11, 12, and 13 may be supplied with the various kinds of signals. In this case, wiring for the connectors 11, 12, and 13 is complicated and therefore difficult.

In cases where personal computers manufactured by different manufacturers are selectively connected, connection to the common peripheral device or the common docking station may be defective even if connectors of the same kind are used in the personal computers. This is because pin assignment of the connector is often different for each manufacturer as known in the art.

Furthermore, if connection to a particular circuit block alone is desired, a special connector for the particular circuit block must be additionally equipped in the personal computer. This requires the connector cost and the mounting cost for the special connector.

SUMMARY OF THE INVENTION

It is therefore an object of this invention to provide a connector that removes the above-mentioned problems by grouping a number of contacts into a plurality of groups or blocks corresponding to individual circuits, respectively.

It is another object of this invention to provide an information processing apparatus equipped with the above-mentioned connector.

Other objects of this invention will become clear as the description proceeds.

According to this invention, there is provided a connector which comprises an insulator, a coupling portion held by the insulator for coupling to a mating connector, and a number of contacts placed inside the coupling portion and held by the insulator for being connected to the mating connector when the coupling portion is coupled to the mating connector, the contacts being grouped into a plurality of contact groups which correspond to intended-uses, respectively, the contacts of each of the contact groups being collectively arranged.

BRIEF DESCRIPTION OF THE DRAWINGS

FIGS. 7A, 7B, and 7C are a front view, a plan view, and a right side view of a connector of a docking station illustrated in FIG. 2, respectively;

FIG. 8 is a plan view of a characteristic part of a circuit board as a connection object of the connector illustrated in FIGS. 7A through 7C;

FIGS. 9A and 9B are a front view and a right side view of a connector of a port replicator illustrated in FIG. 2, respectively;

FIGS. 10A and 10B are perspective views of the connector illustrated in FIGS. 9A and 9B before and after it is connected to a connector of a board mount type, respectively;

FIGS. 17A, 17B, and 17C are a front view, a plan view, and a right side view of a plug as a modification of the connector illustrated in FIGS. 7A through 7C, respectively;

FIGS. 18A, 18B, 18C, 18D, and 18E are a plan view, a front view, a left side view, a rear sectional view, and a side sectional view of a cable connection plug as a modification of the connector illustrated in FIGS. 9A and 9B, respectively;

FIGS. 19A, 19B, and 19C are a front view, a bottom view, and a left side view of a connector usable as a mating connector, respectively;

FIGS. 21A, 21B, and 21C are a front view, a bottom view, and a left side view of still another modification of the mating connector, respectively;

FIGS. 22A, 22B, and 22C are a front view, a bottom view, and a left side view of an example of a locator/ground-plate assembly illustrated in FIGS. 21A through 21C;

FIGS. 23A, 23B, and 23C are a front view, a bottom view, and a left side view of another example of the locator/ground-plate assembly illustrated in FIGS. 21A through 21C.

DESCRIPTION OF THE PREFERRED EMBODIMENTS

Figure 1:
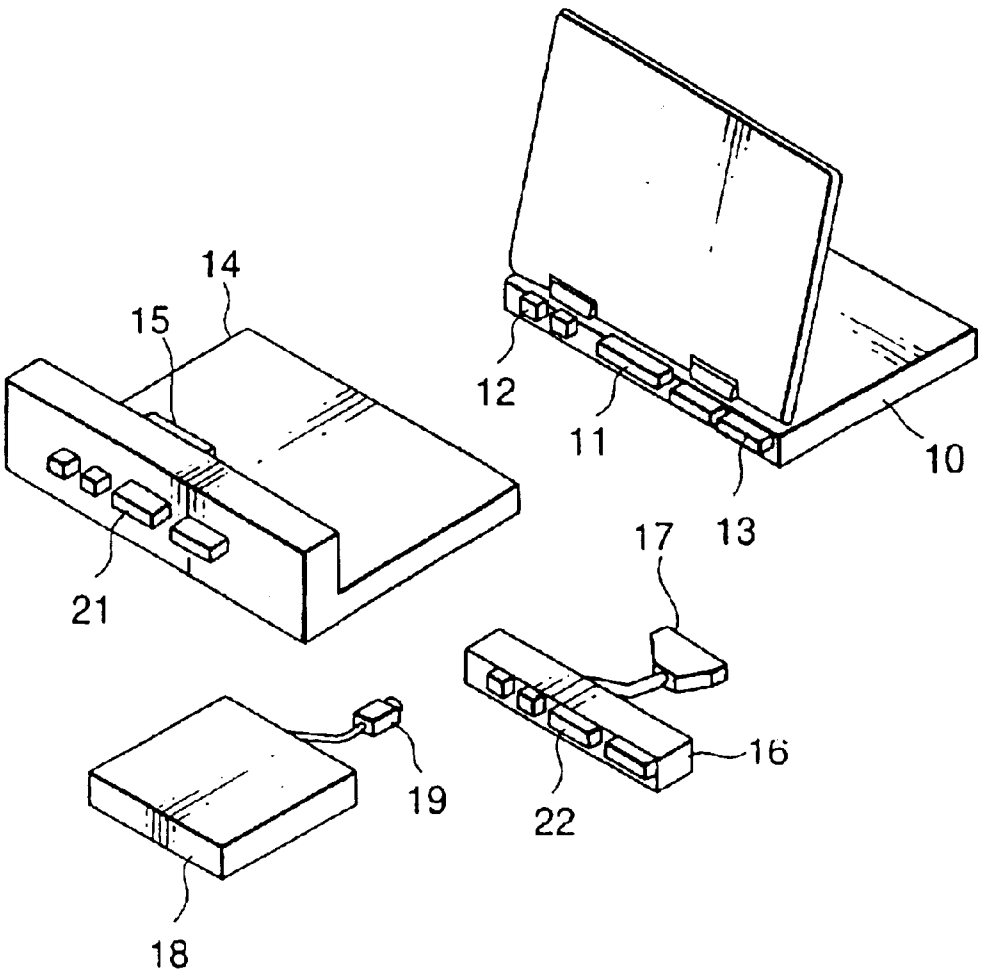
FIG. 1 PRIOR ART
FIG. 1 is a perspective view for describing the use of a personal computer equipped with conventional connectors.

Referring to FIGS. 2 through 5A and 5B, description will be made of a connector according to an embodiment of this invention. Similar parts are designated by like reference numerals and will not be described herein.

Figure 2:
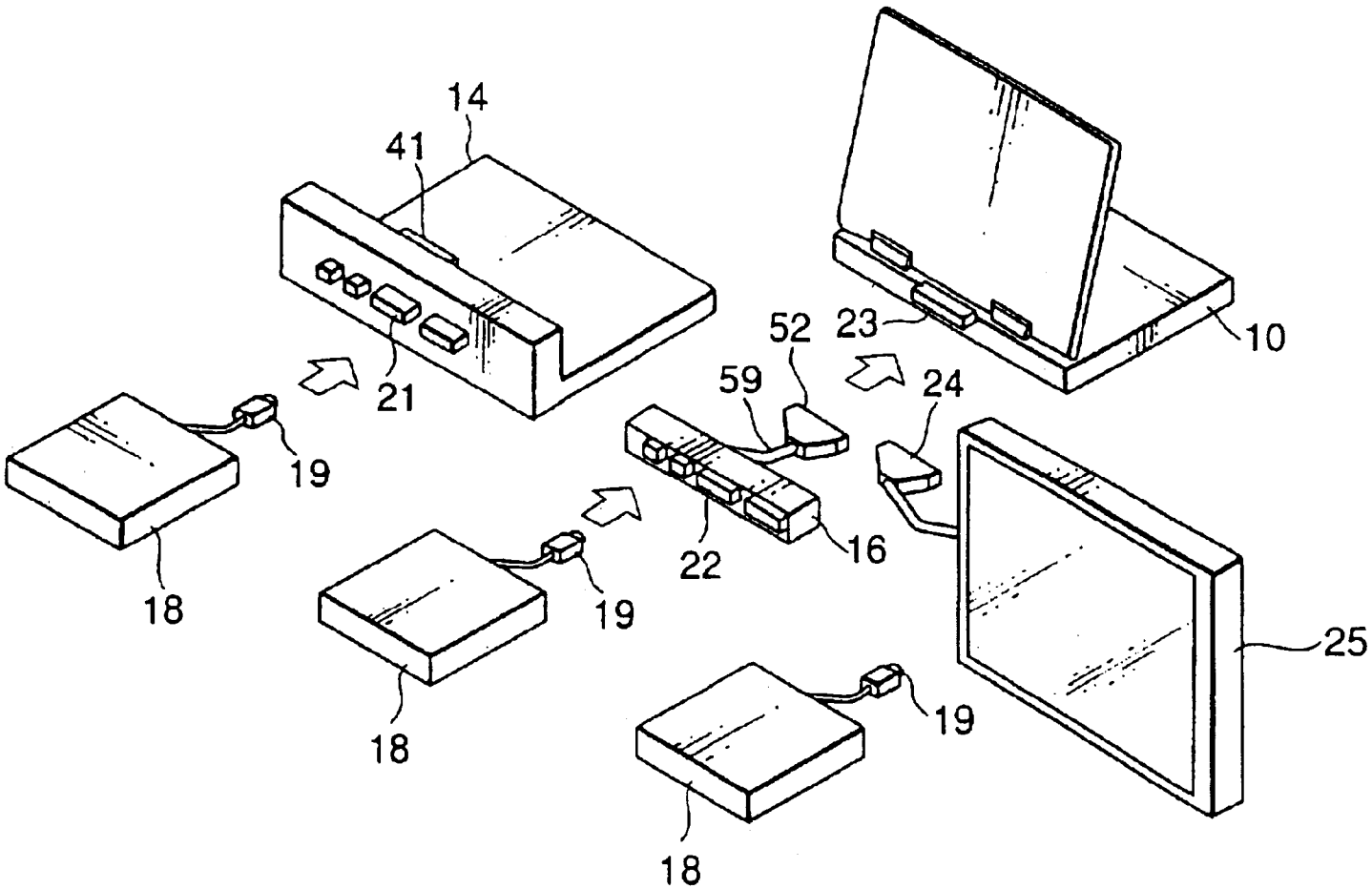
FIG. 2 is a perspective view for describing the use of a personal computer equipped with a connector according to a first embodiment of this invention.

Referring to FIG. 2, a personal computer 10 as an information processing apparatus is provided with a connector 23 on its rear side. A plurality of peripheral devices 18, three in number, are illustrated in the figure.

An external monitor 25 has a connector 24.

As illustrated in FIGS. 3A through 3C and 4, the connector 23 comprises a cylindrical conductive coupling portion 26 to be coupled to a mating connector (which will later be described), a number of conductive contacts 27 arranged within the coupling portion 26, and an insulator 28 holding the coupling portion 26 and the contacts 27. Each contact 27 has a terminal portion 27*a*, to be connected to a circuit board 29 as a connection object and a contacting portion 27*b* to be connected to a mating connector. The circuit board 29 is attached or assembled to a housing 30 of the personal computer 10. The contacts 27 include signal contacts and ground contacts.

Inside the coupling portion 26, the contacts 27 are grouped into a plurality of contact groups 31, 32, 33, 34, and 35 corresponding to intended uses. Alternatively, these contact groups 31, 32, 33, 34, and 35 may correspond to kinds of signals to be dealt with. In the following description, the contact groups 31, 32, 33, 34, and 35 may be referred to as a DFP (Digital Flat Panel) interface portion, a USB (Universal Serial Bus) interface portion, an Institute of Electrical and Electronic Engineers ("IEEE") 394 interface portion, a power supply interface portion, and a legacy interface portion, respectively.

Figure 5:
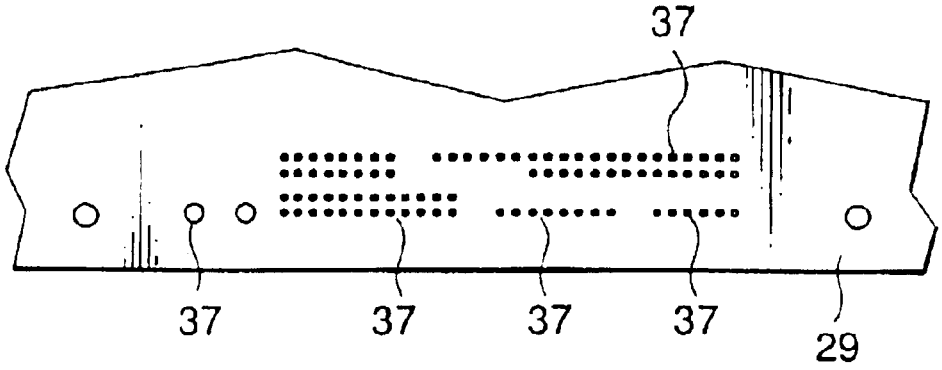
FIG. 5 is a plan view of a characteristic part of a circuit board as a connection object of the connector illustrated in FIGS. 3A through 3C.

As illustrated in FIG. 5, the circuit board 29 is provided with a number of terminal holes 37 for insertion and connection of the terminal portions 27*a* of the contacts 27. Like the contacts 27, these terminal holes 37 are grouped into a plurality of hole groups corresponding to intended uses. Between the groups, an appropriate distance is kept. This means that a number of interlace circuits (not shown) formed on the circuit board 29 are grouped into a plurality of circuit groups. Therefore, those contacts in each contact group are connected to those interface circuits in each corresponding circuit group. In case of an image processing system, the circuit groups or blocks include TMDS (Transition Minimized Differential Signaling), GVIF (Gigabit Video Interface), LVDS (Low Voltage Differential Signaling), LDI (LVDS Display Interface), and VGA (Video Graphics Array). In correspondence to these circuit groups, the contact groups are provided.

Figure 6A:
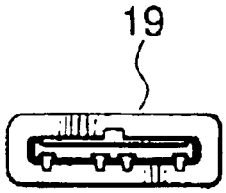
FIGS. 6A and 6B are a front view and a sectional view of a connector of a peripheral device illustrated in FIG. 2, respectively.
Figure 6B:
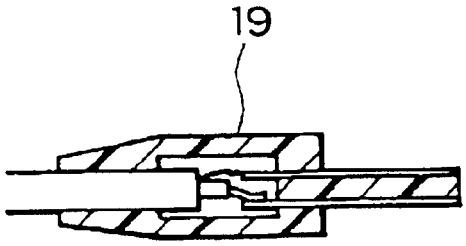

In the connector 23 shown in FIGS. 3A-3C, the contact groups 31, 32, 33, 34, and 35 can be collectively connected to a mating connector which will hereinafter be described. Furthermore, each of the contact groups 31, 32, 33, 34, and 35 can be individually connected to the connector 19 of one of the peripheral devices 18 as the mating connector. Referring to FIGS. 6A and 6B, the connector 19 of the peripheral device 18 is adapted to be connected to the legacy interface portion 35.

Referring to FIGS. 7A through 7C in addition to FIG. 2, the docking station 14 will be described.

The docking station 14 has a connector 41 serving as a mating connector to be connected to the connector 23 of the personal computer 10. The connector 41 comprises a cylindrical conductive coupling portion 46 to be coupled to the coupling portion 26 of the connector 23 of the personal computer 10, a number of conductive contacts 47 arranged inside the coupling portion 46, and an insulator 48 holding the coupling portion 46 and the contacts 47. Each contact 47 has a terminal portion to be connected to a circuit board of the docking station 14 and a contacting portion to be connected to each corresponding contact 27 of the connector 23. Inside the coupling portion 46, the contacts 47 are grouped into a plurality of contact groups corresponding to intended uses, in a manner similar to the contacts 27 of the connector 23 of the personal computer 10. The contact groups are arranged at positions corresponding to those of the contact groups 31, 32, 33, 34, and 35 of the personal computer 10.

Referring to FIG. 8, the docking station 14 has a circuit board 49 provided with terminal holes 51 for insertion and connection of the terminal portions of the contacts 47. Like the contacts 47, the terminal holes 51 are grouped into a plurality of hole groups corresponding to intended uses. Between the groups, an appropriate distance is kept. This means that a number of interface circuits (not shown) formed on the circuit board 49 are grouped into a plurality of circuit groups. Therefore, those contacts in each contact group are connected to the interface circuits in each corresponding circuit group.

Referring to FIGS. 9A and 9B together with FIG. 2, the port replicator 16 will be described.

The port replicator 16 has a connector 52 serving as a mating connector to be connected to the connector 23 of the personal computer 10. The connector 52 comprises a cylindrical conductive coupling portion 56 to be coupled to the coupling portion 26 of the connector 23 of the personal computer 10, a number of conductive contacts 57 arranged inside the coupling portion 56, and an insulator 58 holding the coupling portion 56 and the contacts 67. Each contact 57 has a terminal portion to be connected to a cable 59 and a contacting portion to be connected to each corresponding contact 27 of the connector 23. Inside the coupling portion 56, the contacts 57 are grouped into a plurality of contact groups corresponding to intended uses, in the manner similar to the contacts 27 of the connector 23 of the personal computer 10. The contact groups are arranged at positions corresponding to those of the contact groups 31, 32, 33, 34, and 35 of the personal computer 10.

The connector 24 of the external monitor 25 has a structure similar to that of the connector 52 of the port replicator 16 and can be used as a mating connector.

Referring to FIGS. 10A and 10B, the connector 52 can be used in cases where the connector 23 of the personal computer 10 is a connector 23*a* of a board mount type. FIGS. 10A and 10B show the states before and after the connector 52 is connected to the connector 23A, respectively.

Figure 11A:
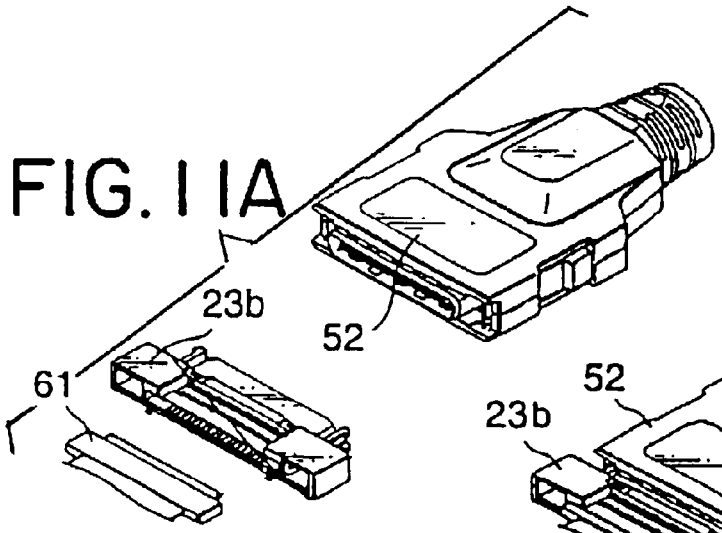
FIGS. 11A and 11B are perspective views of the connector illustrated in FIGS. 9A and 9B before it is connected to a connector of a relay mount type, respectively.
Figure 11B:
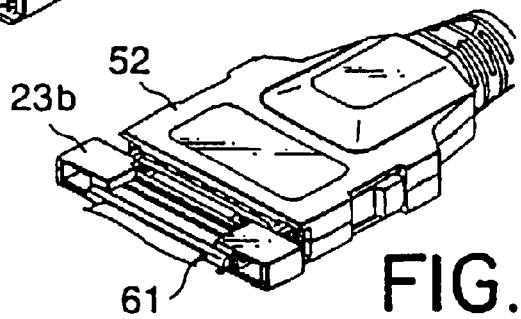
Figure 11C:
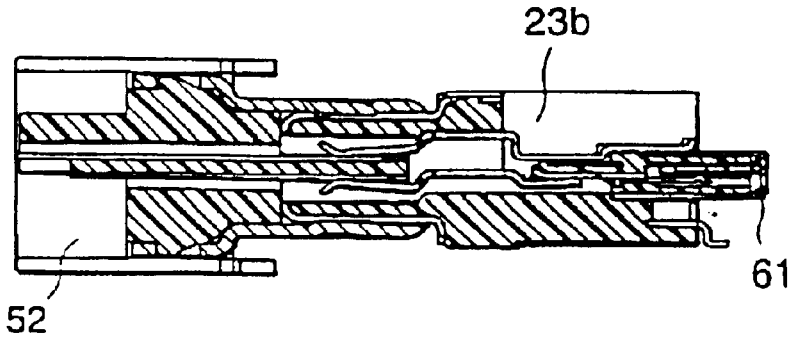
FIG. 11C is a sectional view corresponding to FIG. 11B.

Referring to FIGS. 11A through 11C, the connector 52 can be used in cases where the connector 23 of the personal computer 10 is a connector 23*b* of a relay mount type. FIG. 11A shows the state before the connector 52 and a connector 61 with a cable or an ("FPC") are connected to the connector 23*b*. FIGS. 11B and 11C show the state after they are connected to the connector 23*b*.

Referring to FIGS. 12 through 15, description will be made of various examples of connection.

Figure 12:
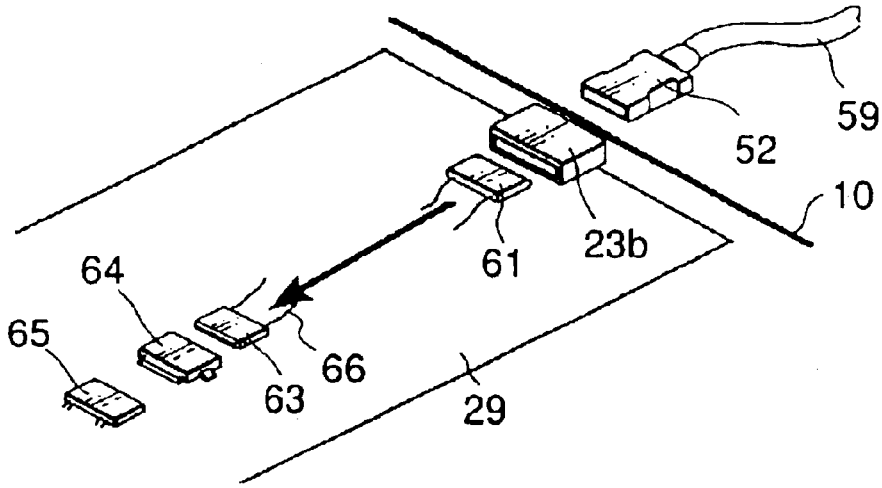
FIG. 12 is a perspective view for describing signal transmission through relay connection by the use of the connector illustrated in FIGS. 9A and 9B.
Figure 13:
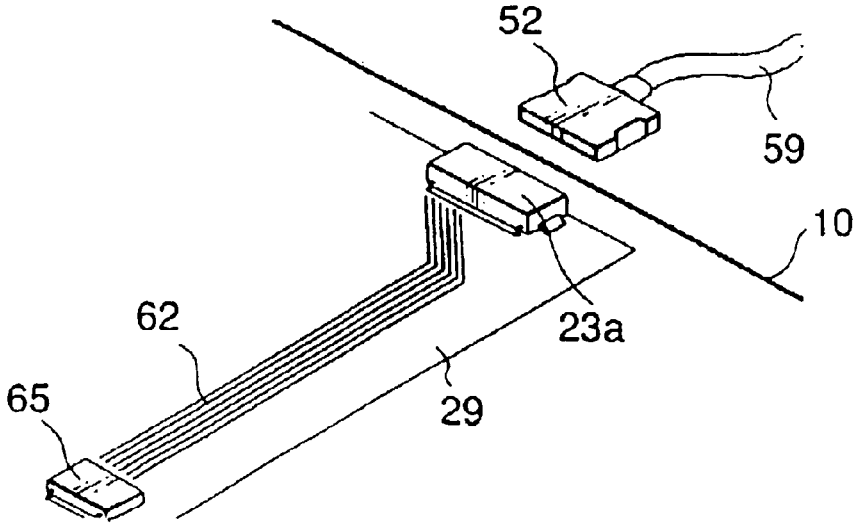
FIG. 13 is a perspective view for describing signal transmission through a board by the use of the connector illustrated in FIGS. 9A and 9B.

In case of signal transmission by the use of the connector 52 and the connector 23*a* or 23*b*, relay connection in FIG. 12 or board-through connection in FIG. 13 may be adopted. In the relay connection, an appropriate circuit block including the connector 61 is inserted so as to readily prevent the disturbance in impedance resulting from crosstalk between board patterns. In the board through connection, the pitch of the board patterns 62 is appropriately selected so as to prevent the disturbance in impedance resulting from the crosstalk. In the figures, reference numerals 63 and 64 represent relay connectors, 65, a transmission chip, and 66, a cable.

Figure 14:
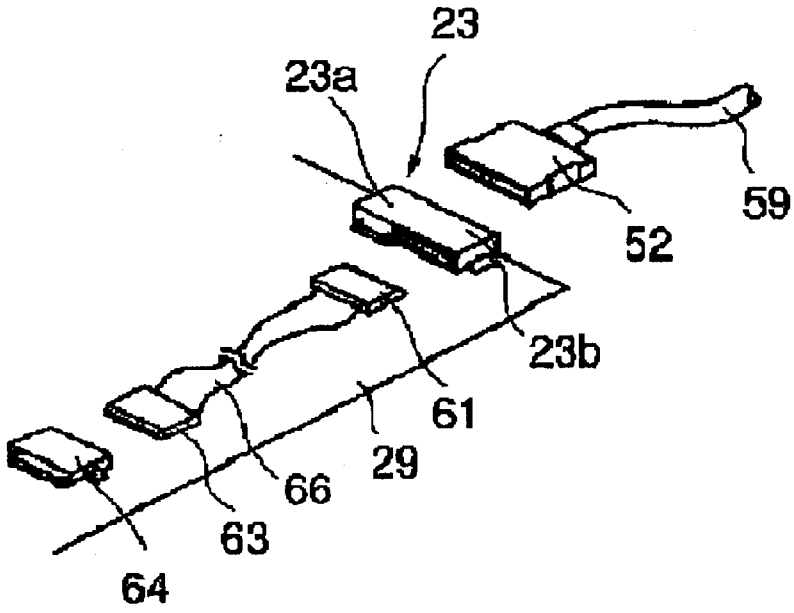
FIG. 14 is a perspective view for describing modification of signal transmission by the use of the connector illustrated in FIGS. 9A and 9B.

Referring to FIG. 14, the connector 23 comprises a structure including the connectors 23*a* and 23*b* integrally combined. With this structure, both board mounting and relay mounting can be carried out.

Figure 15:
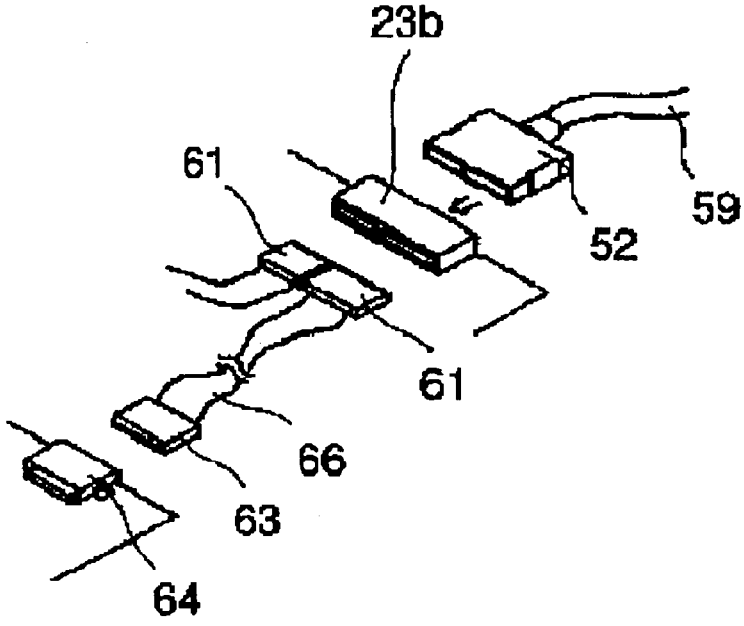
FIG. 15 is a perspective view for describing another modification of signal transmission by the use of the connector illustrated in FIGS. 9A and 9B.

Referring to FIG. 15, the connector 23*b* is adapted to be connected to a plurality of circuit blocks or connectors 61.

Figure 3C:
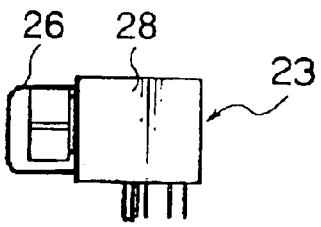
FIGS. 3A, 3B, and 3C are a front view, a plan view, and a right side view of the connector illustrated in FIG. 2, respectively.
Figure 3B:
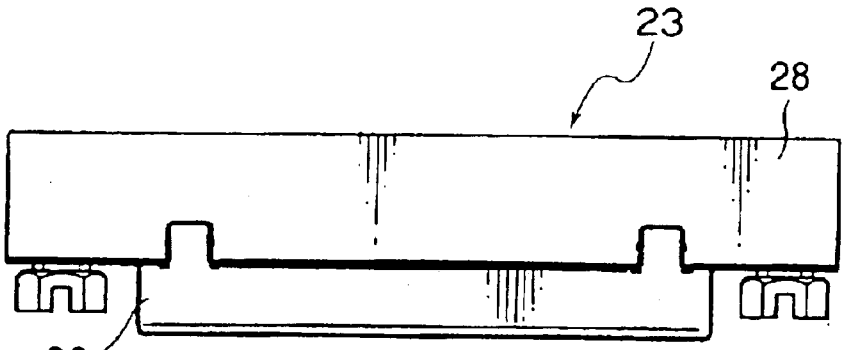
Figure 3A:
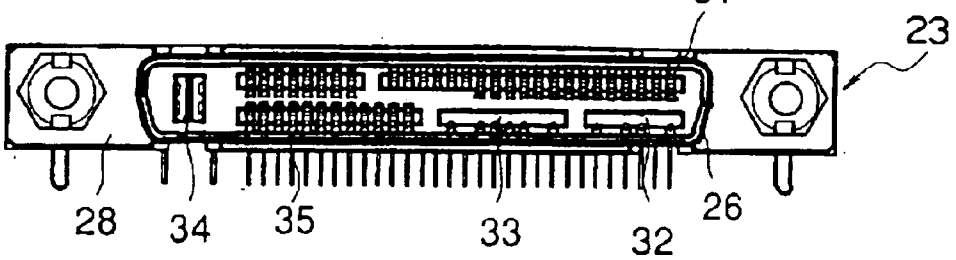
Figure 4:
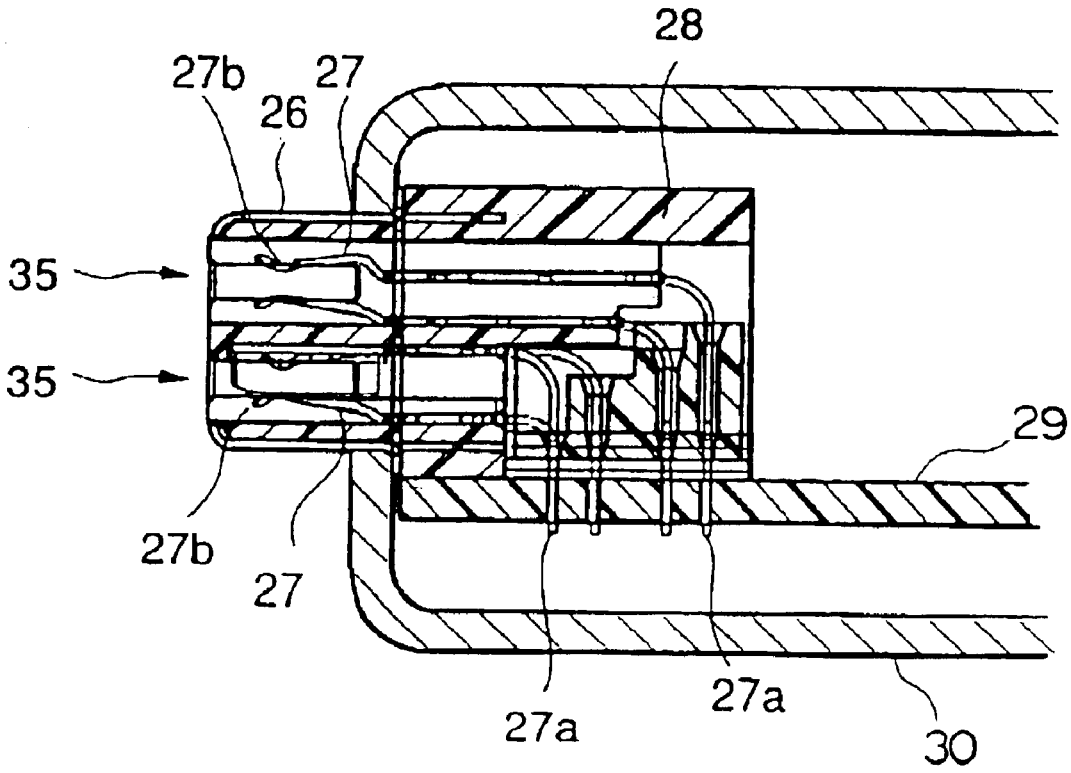
FIG. 4 is a sectional view of the connector illustrated in FIGS. 3A through 3C, where the connector is assembled to a housing.
Figure 16C:
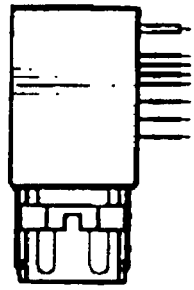
FIGS. 16A, 16B, and 16C are a front view, a plan view, and a right side view of a receptacle as a modification of the connector illustrated in FIGS. 3A through 3C, respectively.
Figure 16B:
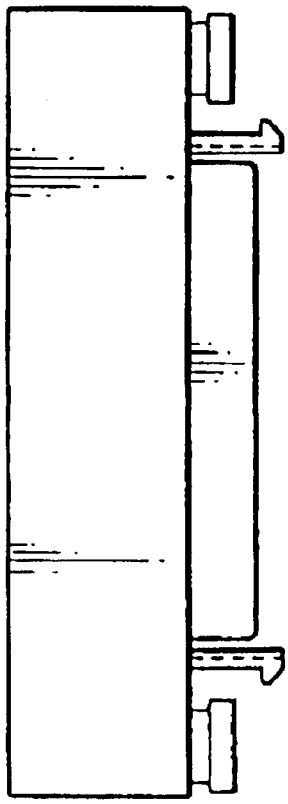
Figure 16A:
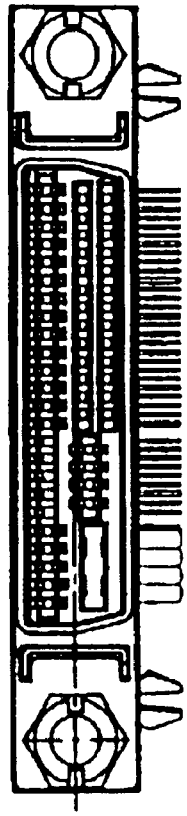

Referring to FIGS. 16A through 16C, a receptacle is illustrated as a modification of the connector 23 in FIGS. 3A through 3C. In the receptacle, a plurality of contact groups corresponding to intended uses are arranged inside the coupling portion 26, like the connector 23 in FIGS. 3A through 3C. With this structure, the contact groups can either collectively or individually be connected to a plug which will hereafter be described.

Referring to FIGS. 17A through 17C, the plug is illustrated as a modification of the mating connector 41 in FIGS. 7A through 7C. In the-plug, a plurality of contact groups corresponding to intended uses are arranged inside the coupling portion 46, like the mating connector 41 in FIGS. 7A through 7C. With this structure, the contact groups can either collectively or individually be connected to the receptacle.

Herein, the receptacle in FIGS. 16A through 16C and the plug in FIGS. 17A through 17C can be coupled and connected to each other. The numbers and the positions of the contact groups in the receptacle and the plug are different from those of the connector 23 in FIGS. 3A through 3C and the mating connector 41 in FIGS. 7A through 7C.

Referring to FIGS. 18A through 18E, a cable connection plug is illustrated as a modification of the connector 52 in FIGS. 9A and 9B. In the cable connection plug, a plurality of contact groups corresponding to intended uses are arranged inside the coupling portion 56, like the connector 52 in FIGS. 9A and 9B. With this structure, the contact groups can either collectively or individually be connected to the mating connector. The numbers and the positions of the contact groups in the cable connection plug illustrated in FIGS. 18A through 18E are different from those of the connector 52 in FIGS. 9A through 9C.

Referring to FIGS. 19A through 19C, description will be made of a modification of the mating connector. The mating connector illustrated in the figure comprises a number of contacts 72 having connecting portions 71 to be connected to a cable or cables (not shown), an insulator 73 holding the contacts 72, and a locator 75, i.e., a metal location plate having a plurality of cable locating portions 74 for locating and holding the cables. The locator 75 has press-fitting portions 76 for press-fitting shields of the cables, and connecting portions 77 to be connected to conductors of the cables.

Figures 20A, 20B, 20C:
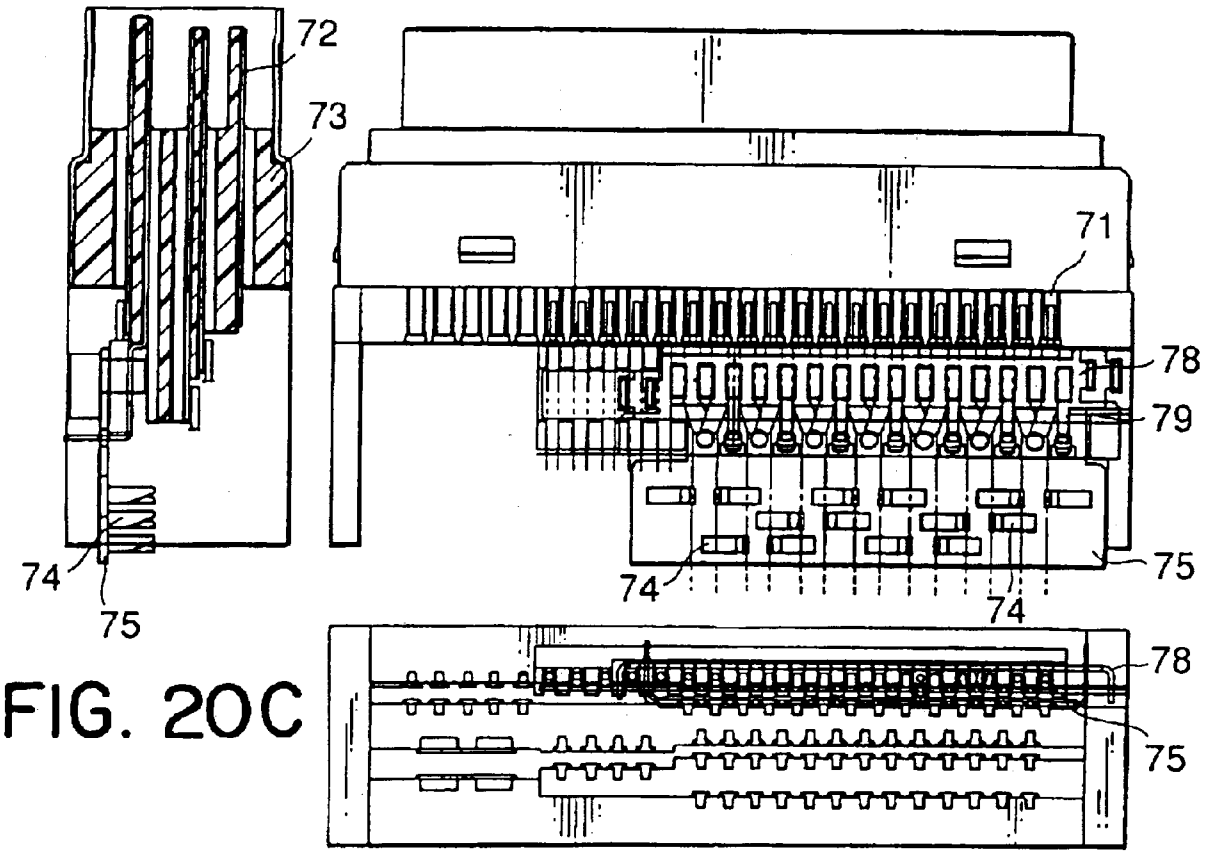
FIGS. 20A, 20B, and 20C are a front view, a bottom view, and a left side view of a modification of the mating connector, respectively.

Referring to FIGS. 20A through 20C, description will be made of another modification of the mating connector. Similar parts are designated by like reference numerals and will not be described any longer. The mating connector being illustrated further comprises a ground plate 78. The ground plate 78 has connecting portions 79 to be connected to the locator 75.

Referring to FIGS. 21A through 21C, still another modification of the mating connector will be described. Similar parts are designated by like reference numerals and will not be described any longer. In the mating connector being illustrated, the locator 75 and the ground plate 78 are integrally formed as a single part.

Referring to 22A through 22C and 23A through 23C a modification of the single part will be described. Similar portions are designated by like reference numerals and will not be described any longer. As illustrated in FIG. 22C, the ground plate 78 is bent perpendicular to the locator 75. The ground plate 78 is folded back in parallel to the locator 75 as illustrated in FIG. 23C. The single part can be assembled with the mating connector in place of the single part illustrated in FIGS. 21A through 21C.

In the mating connectors described in conjunction with FIGS. 19A through 19C to 23A through 23C, a number of contacts are grouped into a plurality of contact groups inside the coupling portion in correspondence with intended uses, like the mating connector 41 illustrated in FIGS. 6A through 6C. With this structure, the contact groups can be connected either collectively or individually.

According to the various embodiments described above, the following advantages will be obtained.

By dividing one connector to a plurality of groups or blocks corresponding to a plurality of circuit blocks, board wiring is easily carried out. This contributes to reduction in cost. The relay connection is also facilitated and transmission characteristics are improved. In addition the productivity (yield) is improved and the cost is reduced. Connection to a particular circuit block alone is possible without using a special connector. This saves the connector cost, the board cost, and the mounting cost so that the total cost is considerably reduced. By adopting the relay connection to the personal computer, impedance matching is easily achieved and the transmission characteristics are improved. Therefore, the board cost is reduced and the yield is improved so that the total cost is significantly reduced.

Figure 24:
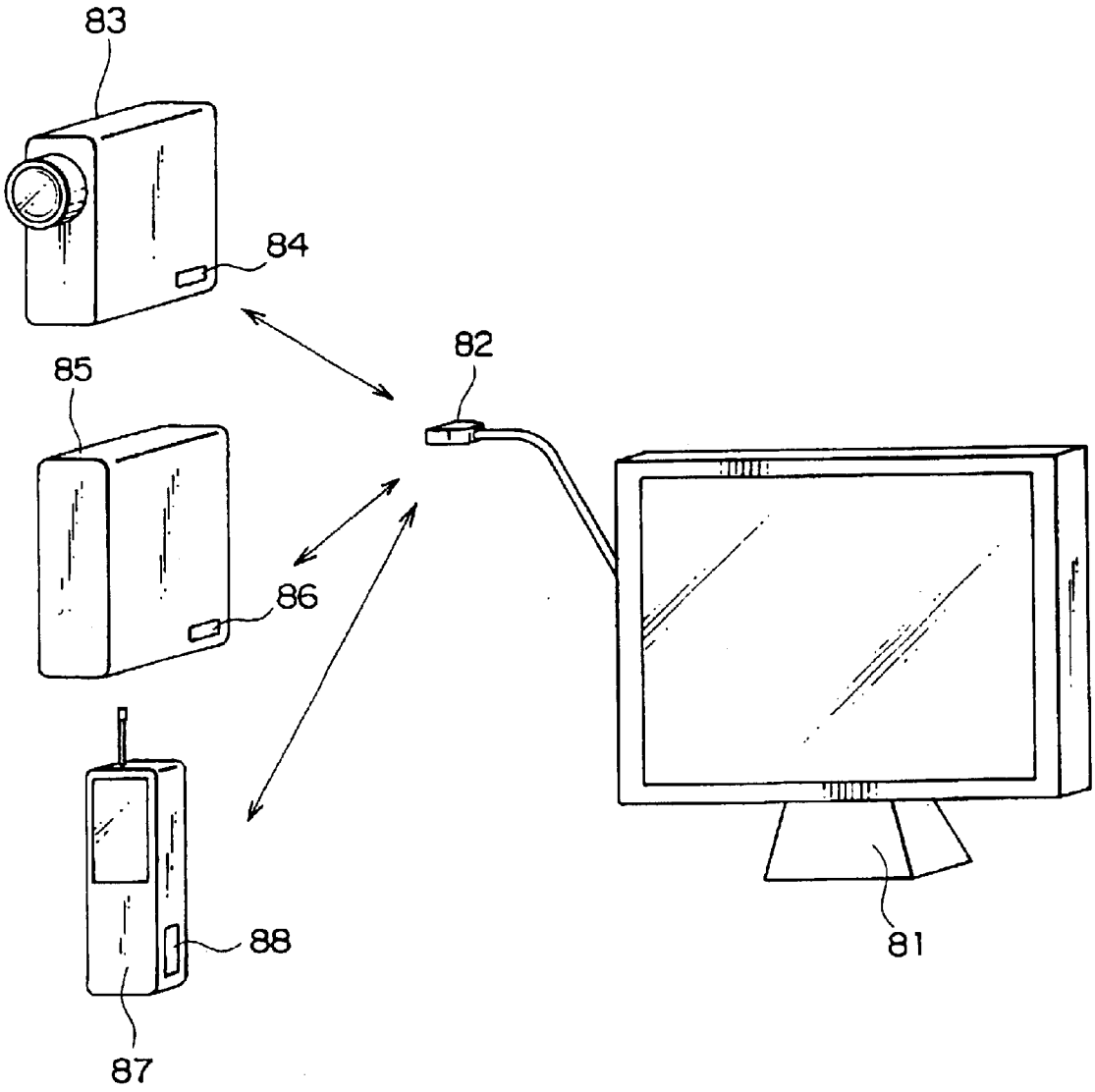
FIG. 24 is a view for describing an example of use of the connector according to this invention.

Referring to FIG. 24, description will be made of an example of practical application of this invention.

A display 81 is connected to a cable connector 82 including a plurality of contact groups inside a coupling portion in correspondence to intended uses, like the connector illustrated in FIGS. 9A and 9B. On the other hand a DVC (Digital Video Camera) 83, a game apparatus 85, and a mobile telephone apparatus 87 have connectors 84, 86, and 88, respectively, each of which can be connected to each corresponding contact group of the cable connector 82. With this structure, one of the DVC 83, the game apparatus 85, and the mobile telephone apparatus 87 can be selectively connected to the cable connector 82 connected to the display 85. Thus, the display 81 is simplified in its connector arrangement.

Herein, description is directed to the case where the display is connected to the DVC, the game apparatus, or the mobile telephone apparatus. However, it will readily be understood that this invention is also applicable to connection of various other apparatuses or devices.

As described above, according to this invention, it is possible to provide the connector in which the contacts are grouped or blocked into groups respectively corresponding to circuits, the information processing apparatus equipped with the connector, and the mating connector to be connected to the connector.

What is claimed is:

1. A connective apparatus in which a number of contacts are grouped into a plurality of contact groups according to intended use, comprising:

an insulator;

a mating connector;

a cylindrical conductive coupling portion held by said insulator to be fit closely to said mating connector and to be connected electrically to said mating connector;

a plurality of contacts placed inside said coupling portion and held by said insulator to be connected to said mating connector when said coupling portion is coupled to said mating connector, said contacts being grouped inside said coupling portion to make a plurality of contact groups that correspond to intended uses, said mating connector comprising:

a plurality of mating contacts;

a locator coupled to said mating contacts, comprising:

a ground plate connected to said locator, wherein said locator and said ground plate are integrally-formed as a single part;

a cable-locating portion for locating a cable having a conductor and a shield surrounding said conductor;

a press-fitting portion connected to said cable-locating portion for press-fitting over said shield; and a connecting portion connected to said cable-locating and said press-fitting portions for being connected to said conductor, wherein said locator and said ground plate extend parallel to each other.

2. An apparatus as claimed in claim 1, wherein each of said contacts has a terminal portion for being connected to an interface circuit formed on a circuit board.

3. An apparatus as claimed in claim 1, further comprising:

a mating insulator; and a cylindrical conductive mating coupling portion held by said mating insulator to be fit closely to the coupling portion of the connector, said mating contacts being placed inside said mating coupling portion and held by said mating insulator to be connected to the contacts of the connector when said mating coupling portion is coupled to the coupling portion of the connector, said mating contacts being grouped inside said mating coupling portion to make a plurality of mating contact groups that correspond to intended uses, said mating contacts of each said mating contact groups being collectively arranged.

* * * * *